US010531191B2

(12) United States Patent
Macours

(10) Patent No.: US 10,531,191 B2
(45) Date of Patent: Jan. 7, 2020

(54) CONTROLLER FOR HAPTIC FEEDBACK ELEMENT

(71) Applicant: NXP B.V., Eindhoven (NL)

(72) Inventor: Christophe Marc Macours, Hodelge (BE)

(73) Assignee: NXP B.V., Eindhoven (NL)

( * ) Notice: Subject to any disclaimer, the term of this patent is extended or adjusted under 35 U.S.C. 154(b) by 437 days.

(21) Appl. No.: 15/292,594

(22) Filed: Oct. 13, 2016

(65) Prior Publication Data

US 2017/0111734 A1 Apr. 20, 2017

(30) Foreign Application Priority Data

Oct. 16, 2015 (EP) ..... 15190313

(51) Int. Cl.
*H04R 3/00* (2006.01)
*G10L 25/84* (2013.01)

(52) U.S. Cl.
CPC ..... *H04R 3/005* (2013.01); *G10L 25/84* (2013.01); *H04R 2460/13* (2013.01); *H04R 2499/11* (2013.01)

(58) Field of Classification Search
CPC ..... G08B 6/00; H04M 19/047; H04R 3/005; H04R 1/46; H04R 5/04; H04R 2460/13; H04R 2499/11
USPC ..... 381/326, 331, 151, 111–115, 74, 122, 381/178; 345/173
See application file for complete search history.

(56) References Cited

U.S. PATENT DOCUMENTS 5,986,813 A * 11/1999 Saikawa ..... G02B 27/017 359/630
7,512,425 B2 * 3/2009 Fukuda ..... H04M 1/03 455/550.1
9,947,186 B2 * 4/2018 Macours ..... G06F 3/016
2011/0208520 A1 8/2011 Lee
2014/0119569 A1 * 5/2014 Peeler ..... H04B 15/00 381/94.1
2015/0138157 A1 * 5/2015 Harris ..... G06F 3/016 345/175

(Continued)

FOREIGN PATENT DOCUMENTS

EP 1 705 874 A1 1/2005
EP 2 698 970 A1 2/2014
WO WO-2010/083888 A1 7/2010

(Continued)

OTHER PUBLICATIONS

Extended European Search Report for Patent Appln. No. 15190313.5 (Feb. 26, 2016).

(Continued)

*Primary Examiner* — Xu Mei

(57) ABSTRACT

A controller for a haptic feedback element is described, the haptic feedback element being configured to generate haptic vibrations, wherein the controller comprises a sense input and is configured to sense a signal induced on at least one terminal of the haptic feedback element in response to an external vibration source. The controller may sense vibrations induced one or more terminals of a haptic feedback element. The external vibration source may for example be due to speech transmitted via bone conduction which can be detected and subsequently processed.

13 Claims, 5 Drawing Sheets

(56) References Cited

U.S. PATENT DOCUMENTS

2016/0050488 A1* 2/2016 Matheja ..... H04R 3/005
381/56

FOREIGN PATENT DOCUMENTS

| | | | |
|---|---|---|---|
| WO | WO-2013/128442 | A1 | 9/2013 |
| WO | WO-2013/171512 | A2 | 11/2013 |
| WO | WO-2013/171512 | A3 | 11/2013 |
| WO | WO-2015/047309 | A1 | 4/2015 |

OTHER PUBLICATIONS

Liu, Zicheng et al; "Direct Filtering for Air- and Bone-Conductive Microphones"; IEEE 6th Workshop on Multimedia Signal Processing, Sep. 29-Oct. 1, 2004; 4 page (2004).

* cited by examiner

200

300

400

450

500

550

CONTROLLER FOR HAPTIC FEEDBACK ELEMENT

CROSS-REFERENCE TO RELATED APPLICATIONS

This application claims the priority under 35 U.S.C. § 119 of European patent application no. 15190313.5, filed Oct. 16, 2015 the contents of which are incorporated by reference herein.

This disclosure relates to a controller for a haptic feedback element, and a method of vibration sensing for a device comprising a haptic feedback element.

Speech capture in noisy environments requires dedicated measures to suppress unwanted noise from the user speech so as to improve speech quality and intelligibility. These measures encompass the use of (stationary) noise suppression algorithms using single or multiple microphones.

In the particular case of wind noise, classical noise reduction algorithms fail to provide satisfying results, due to the specific properties of wind noise, such as dominant low frequency components which usually mask the useful signal and very low correlation across multiple microphones, preventing the use of beamforming.

Various aspects of the invention are defined in the accompanying claims. In a first aspect there is defined a controller for an haptic feedback element wherein the controller comprises a sense input and is configured to sense a signal induced on at least one terminal of the haptic feedback element in response to an external vibration source.

The controller is configured to use the haptic feedback element to detect an external vibration source, that is to say a vibration source other than the haptic vibrations generated by the haptic feedback element. This allows the haptic feedback element to be used as a vibration sensor.

In one or more embodiments the controller is further configured to detect speech in the induced signal. The detected vibrations may for example include speech. When a person speaks, the speech signal may be transmitted via bone conduction. These speech vibrations may be detected and processed.

In embodiments the controller may further comprise a microphone input configured to sense a microphone signal.

In embodiments, the controller may comprise a low pass filter coupled to the sense input, a high-pass filter coupled to the microphone signal input and a mixer coupled to an output of the high-pass filter and an output of a low pass filter.

In embodiments, the controller may comprise an equalizer coupled to the sense input and further configured to apply equalization to the induced signal such that the effective passband of the haptic feedback element is increased.

In embodiments, the controller may be incorporated in a mobile device comprising an haptic feedback element, and an haptic feedback element driver having an output switchably coupled to the at least one haptic feedback element terminal, wherein the sense input is switchably coupled to the at least one haptic feedback element terminal and the controller is configured to couple the output of the amplifier to the haptic feedback element terminal in a first mode of operation and to couple the sense input to the at least one haptic feedback element terminal in a second mode of operation.

In embodiments the haptic feedback element may comprise an electrodynamic haptic feedback element.

Examples of haptic feedback elements include a linear resonance actuator and other electrodynamic vibration actuators that are designed to generate haptic feedback using haptic vibration when driven by a time varying or ac signal. A haptic vibration may be considered to be a vibration that can be detected or felt by touching. Electrodynamic haptic feedback elements may be designed with a high Q factor and designed to resonate at a frequency at which the user can detect the vibrations generated. An electrodynamic haptic feedback element may have a concentric coil and permanent magnet.

In a second aspect there is described a method of sensing a vibration for a device comprising a haptic feedback element, the haptic feedback element being configured to generate haptic vibrations, the method comprising sensing a signal induced on at least one terminal of the haptic feedback element in response to in response to an external vibration source.

In embodiments the method may comprise detecting speech in the induced signal.

In embodiments the method may comprise combining the induced signal with a further audio signal.

In embodiments the method may comprise applying a high-pass filter to the induced signal, applying a low-pass filter to the further audio signal and mixing the high-pass filtered signal and the low-pass filtered signal.

In embodiments, the method may comprise equalizing the induced signal to increase the effective passband of the haptic feedback element.

In a third aspect there is described the use of a haptic feedback element as a bone conduction microphone sensor. The haptic feedback element may be used to detect vibrations for example due to human speech transmitted via bone conduction and consequently can be used as a bone conduction microphone. In embodiments the haptic feedback element may be suitable for a mobile device such as a mobile phone and used to provide the handset vibrate feature. The haptic feedback element may be a linear resonance actuator.

The speech transmitted via a bone conduction path may have a better signal to noise ratio than speech transmitted via air.

In the figures and description like reference numerals refer to like features. Embodiments are now described in detail, by way of example only, illustrated by the accompanying drawings in which:

DESCRIPTION

Figure 1:
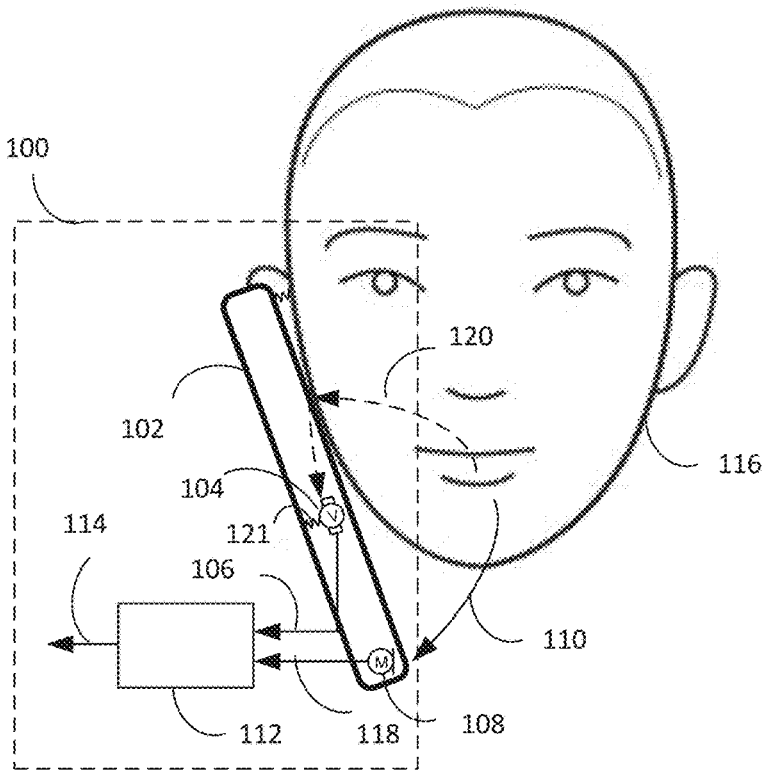
FIG. 1 shows a mobile phone including a controller for a haptic feedback element according to an embodiment.

FIG. 1 shows a mobile phone 100 in accordance with an embodiment. Mobile phone 100 is illustrated in contact with a mobile phone user 116. The mobile phone 100 includes microphone 108 for capturing the speech of the user 116. The mobile phone 100 also includes a haptic feedback element 104 which is mechanically coupled by mechanical coupling 121 to the housing 102 of the mobile phone 100. The mechanical coupling 121 may be a spring. Haptic feedback element 104 is typically used in a so called "vibrate mode" or "silent mode" of operation to alert the user of an event by causing vibrations in the housing 102. This event may for example be an incoming phone call, and email or a text. The vibrations induced in the housing 102 by the haptic feedback element 104 may provide haptic feedback to a user 116 in contact with the housing 102. The haptic feedback element 104 may be a linear resonance actuator (LRA) which typically has two terminals connected to a driver circuit (not shown). The Q factor of the LRA is typically a high value, for example a value of 20. The LRA may have a resonance peak at approximately 200 Hz which may generate a large enough g-force to induce detectable vibrations in the housing 102. The driver which may be an amplifier such as a class D amplifier may apply an ac signal at or close to the resonance peak frequency to cause the linear resonance actuator to induce vibrations in the housing 102. These vibrations may be detected by the user 116 in physical contact with the housing 102 and so provide haptic feedback to the user 116. In other examples the LRA may have a resonant frequency between 150 Hz and 300 Hz.

A controller 112 may have a sense input 106 connected to at least one of the terminals of the haptic feedback element 104. The controller 112 may have a microphone input 118 connected to the microphone 108. The controller 112 is illustrated as being outside the housing 102 in FIG. 1, but as will be appreciated by the skilled person, the controller 112 will be included in the housing 102. The inventor of the present application has realised that the haptic feedback element 104 present in a mobile phone may also be used as a vibration sensor. In operation, when the haptic feedback element 104 is not been driven, that is to say not been used for its intended purpose of generating vibrations, an external source of vibration may cause the haptic feedback element 104 to generate a signal on one or more of its input terminals. This induced signal may be sensed by the controller 112. The controller 112 may increase the effective bandwidth of the frequency response of the haptic feedback element 104 by, for example, applying an inverse equalisation to the induced signal. This may for example increase the bandwidth to a range between 100 Hz to 500 Hz. In other examples the effective bandwidth may be increased to 1 kHz. An example path of speech transmitted as vibrations via bone conduction in the user is shown schematically as dashed line path 120. When the mobile phone 100 is in physical contact with the user 116, the speech transmitted via bone conduction may induce a signal on the terminals of the haptic feedback element 104. The induced signal may be sensed by the controller 112. The controller 112 may process and output the sensed speech signal on the controller output 114.

The resulting speech signal may have less noise than a speech signal sensed via the microphone 108, which may be transmitted from the user through an air path 110, since the speech transmitted via bone conduction may be less susceptible to interference from background noise sources, such as for example wind noise. The speech signal sensed via the haptic feedback element 104 may be combined with the speech signal sensed via the microphone 108 and processed by the controller to further improve the speech quality.

The controller 112 may be implemented as hardware, software or a combination of hardware and software. The controller 112 may for example include an analog to digital converter coupled to a digital signal processor (DSP) which may execute, for example equalization, filtering as software programs running on the DSP. Alternatively equalization and filtering may be implemented as hardware circuits.

Figure 2:
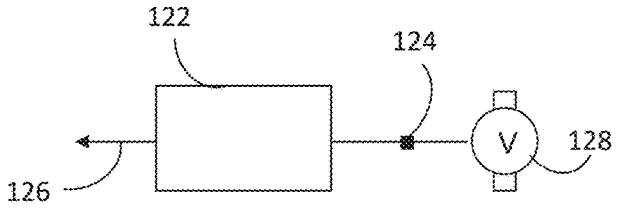
FIG. 2 illustrates a controller for a haptic feedback element according to an embodiment.

FIG. 2 shows a controller 122 according to an embodiment. The controller 122 may have a sense input 124 and a controller output 126. In operation the sense input 124 may be connected to a terminal of a haptic vibration motor 128 which is suitable for use in a mobile device such as a mobile phone, a wearable electronic device, an audio headset, a portable digital assistant, a laptop, a tablet computer, portable medical equipment, an mp3 player, or a so called "hearable" device. A "hearable" device may for example be a wearable electronic device intended to be placed in the user's ear. A hearable device may include similar functionality to the basic headset functionality with the addition of activity sensors and context awareness.

The haptic vibration motor 128 may for example be a linear resonance actuator which is designed for generating vibrations in a mobile phone. The vibrations generated by the haptic vibration motor 128 may be used to provide haptic feedback to a user and so the haptic vibration motor 128 may be considered as a haptic feedback element. In operation the controller 122 may sense a signal induced on one or more terminals of the haptic vibration motor 128 which are typically connected to a haptic driver (not shown). The induced signal may be generated by the haptic vibration motor 128 in response to an external vibration. The induced signal may be inverse equalized by the controller 122. The inverse equalization may increase the effective bandwidth of the frequency response of the haptic vibration motor 128.

The output signal on the controller output 126 may be further processed and/or combined with microphone signals or signals from other acoustic transducers to improve the quality of speech or other audio signal. The controller 122 may sense vibrations resulting from background noise which may then be used to characterize the background noise and remove the noise components from a desired signal. Alternatively the controller 122 may sense vibrations caused by speech transmitted via bone conduction in which case the sensed signal may be processed as the desired signal on its own or in combination with signals from audio sensors such as a microphone.

The controller 122 may be incorporated into a device such as an audio headset, mobile phone or other device incorporating a haptic feedback element. The controller 122 may be implemented as hardware, software or a combination of hardware and software. The controller 122 may for example include an analog to digital converter coupled to a digital signal processor (DSP) which may execute, for example equalization, filtering as software programs running on the DSP. Alternatively equalization and filtering may be implemented as hardware circuits.

Figure 3:
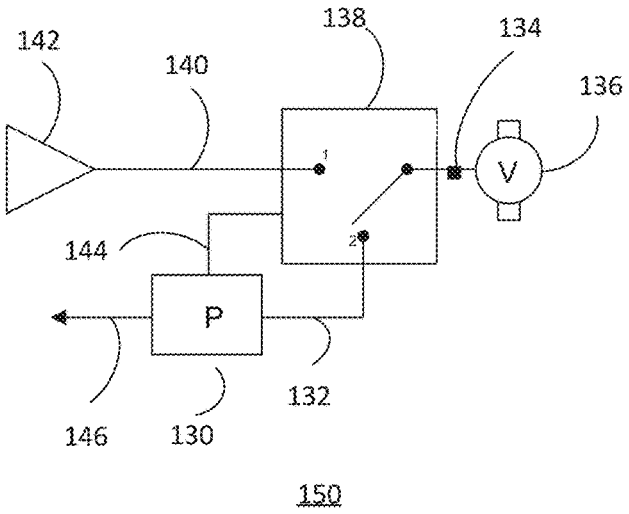
FIG. 3 shows a mobile device according to an embodiment.

FIG. 3 shows a mobile device 150. A controller 130 may have a sense input 132, a signal output 146 and a control output 144. The control output 144 may be connected to a switch module 138. The sense input 132 may be connected to the switch module 138. A haptic feedback element 136 may have at least one terminal 134 connected to the switch module 138. A haptic driver 142 may have an output 140 connected to the switch module 138. In operation, in a first mode the controller 130 may control the switch module 138 to connect either the output 140 of the haptic driver 142 to the terminals 134 of the haptic feedback element 136. In a second mode of operation the controller 130 may connect the sense input 132 to the terminals 134 of the haptic feedback, 136 and disconnects the output 140 of the haptic driver 142 from the terminals 134 of the haptic feedback element 136. In the first mode of operation, which may also be referred to as the haptic mode or vibration mode, the haptic feedback element 136 may be used in an intended mode of operation to generate vibrations. The generated vibration may be used for haptic feedback.

In the second mode of operation, the haptic feedback element 136 may be considered to be configured as a vibration sensor, and the controller 130 may sense vibration from an external source which may induce a signal on the terminals 134. The signal may be sensed by the sense input 132. The controller 130 may process the signal received on input 132 and output a process signal on the controller output 146. The output signal on the controller output 140 may be further processed and/or combined with microphone signals or signals from other acoustic transducers to improve the quality of speech or other audio signal. The controller 130 may sense vibrations resulting from background noise such as wind noise which may then be used to characterize the background noise and remove the noise components from a desired signal. Alternatively the controller 130 may sense vibrations caused by speech transmitted via bone conduction in which case the sensed signal may be processed as the desired signal on its own or in combination with signals from audio sensors such as a microphone (not shown).

The haptic feedback element 136 may for example be a linear resonance actuator. The induced signal may be inverse equalized by the controller 130. The inverse equalization may increase the effective bandwidth of the frequency response of the haptic feedback element 136.

The controller 130 may be implemented as hardware, software or a combination of hardware and software. The controller 130 may for example include an analog to digital converter coupled to a digital signal processor (DSP) which may execute, for example equalization, filtering as software programs running on the DSP. Alternatively equalization and filtering may be implemented as hardware circuits. The skilled person will appreciate that the switch module 138 may be implemented for example using transistors controlled by a control signal from the control output 144.

Figure 4:
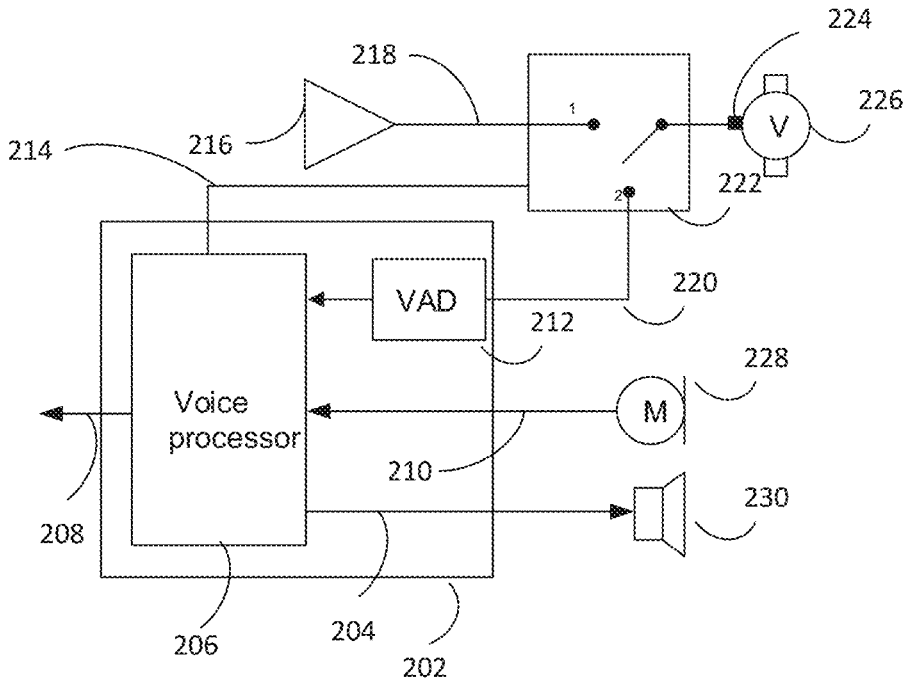
FIG. 4 illustrates a controller incorporated in a mobile phone according to an embodiment.

FIG. 4 shows a mobile phone 200. The mobile phone 200 may have a receiver speaker 230 and a microphone 228 which may be used in a so-called handset mode of operation whereby the phone is in contact with the head of a user. A vibration motor 226 which may be a linear resonance actuation vibrator is coupled to the mobile phone housing (not shown) and used to generate vibrations for haptic feedback. The vibration motor 226 may be considered to be a haptic feedback element. The vibration motor terminals 224 may be connected to switch module 222. A controller 202 may have a sense input 220 connected to the switch module 222. The controller 202 may have a voice activity detector 212 and a voice processor 206. The sense input 220 may be connected to the input of the voice activity detector 212. The microphone 228 may be connected to a microphone input 210 of the voice processor 206. A speaker output 204 of the voice processor 206 may be connected to the receiver speaker 230. The voice processor 206 may have an audio output 208. The voice processor 206 may have a control output 214 which may be connected to the switch module 222. A voice activity detector output may be connected to the voice processor 206. A haptic driver amplifier 216 may have an output 218 connected to the switch module 222.

In a first mode of operation, the voice processor 206 may control the switch module 222 to connect the vibration motor terminals 224 to the haptic driver amplifier 216. In this mode the vibration motor 226 may generate vibrations for haptic feedback. In a second mode of operation, the voice processor 206 may control the switch module to connect the vibration motor terminals 224 to the sense input 220 of the controller.

In a second mode of operation the vibration motor 226 may be considered to be configured as a vibration sensor. The vibration motor 226 may react to speech transmitted via bone conduction in the user by generating a signal on the vibration motor terminals 224. The induced signal may be sensed by the voice activity detector 212. The voice activity detector 212 may output a signal to the voice processor 206 indicating that speech has been detected. Since speech signals transmitted by bone conduction are usually less contaminated with noise than speech signals transmitted through the air, the voice activity detector may reliably detect speech. The signal generated by the voice activity detector 212 may be a simple event signal such as an interrupt. The event signal may be used for example to "wake up" the voice processor 206. The voice activity detector 212 may be implemented in hardware, software, or a combination of hardware and software. The voice processor 206 may be implemented in hardware, software, or a combination of hardware and software. The skilled person will appreciate that the voice processor 206 may perform noise suppression, and acoustic echo cancellation by adapting filters, and noise suppression settings.

Figure 5:
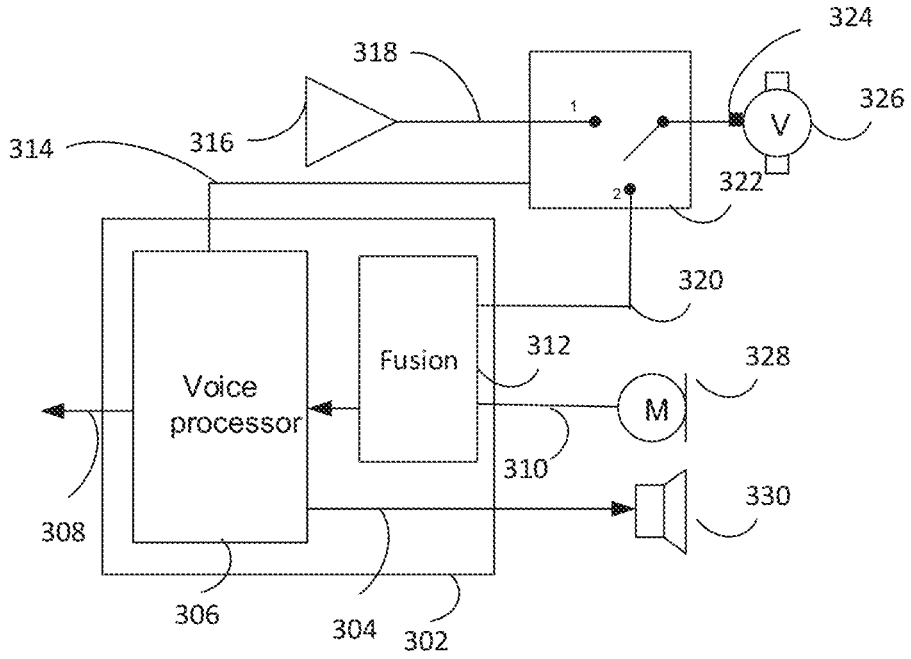
FIG. 5 shows a controller incorporated in a mobile phone according to an embodiment.

FIG. 5 shows a mobile phone 300. Mobile phone 300 has a receiver speaker 330 and a microphone 328 which may be used in a so-called handset mode of operation whereby the phone is in contact with the head of a user. A vibration motor 326 which may be a linear resonance actuation vibrator may be coupled to the mobile phone housing (not shown) and used to generate vibrations for haptic feedback. The vibration motor 326 may be considered to be a haptic feedback element. The vibration motor terminals 324 may be connected to switch module 322. A controller 302 may have a sense input 320 connected to the switch module 322. The controller 302 may have a fusion module 312 and a voice processor 306. The sense input 320 may be connected to the input of the fusion module 312. The microphone 328 may be connected to the voice processor 306. A speaker output 304 of the voice processor 306 may be connected to the receiver speaker 330. The voice processor 306 may have an audio output 308. The voice processor 306 may have a control output 314 which may be connected to the switch module 322. A haptic driver amplifier 316 may have an output 318 connected to the switch module 322.

In a first mode of operation, the voice processor 306 may control the switch module 322 to route the output of the haptic feedback amplifier 318 to the haptic motor 326. In this mode of operation the output of the haptic feedback amplifier 318 may be connected to the haptic motor terminals 324, and the sense input of the fusion module 312 may be disconnected from the haptic motor terminals 324. In this mode of operation, the haptic motor 326 may be used to generate vibrations in a housing (not shown) of the mobile phone 300. In a second mode of operation, the voice processor 306 may control switch module 322 to connect the haptic motor terminals 324 to the sensor input 320. In the second mode of operation the haptic motor 326 may be considered to be configured as a vibration sensor. The fusion module 312 may combine the vibration signal from the haptic motor with a microphone signal received on input 310. The combined microphone signal and vibration signal may then be output to the voice processor 306. When the mobile phone 300 is being used in a handset mode in contact with the head of a user, the detected vibrations represent the speech of a user which may be combined with the microphone signal to improve the intelligibility of the received speech. Alternatively or in addition when the mobile phone 300 is not in contact with the user, the vibrations detected may represent unwanted noise artefacts which may then be characterised and eliminated from the microphone signal.

Figure 6:
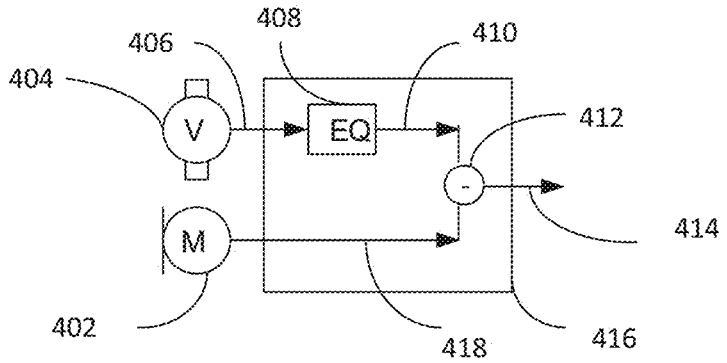
FIG. 6 illustrates a mobile device according to an embodiment.

FIG. 6 shows a mobile device 400 including an example of a fusion module 416. Fusion module 416 may include an equaliser 408 having an input 406 which may be connected to a haptic motor 404. An output of equaliser 408 may be connected to a mixer module 412 which may perform a difference operation. An output 418 of microphone 402 may be connected to the mixer module 412 may be connected to the microphone 402. The mixer module 412 may output a signal on output 414 representative of the difference between a signal sensed on the terminals 406 of the haptic motor 404, and the microphone signal received on input 418. In operation, in a first mode the haptic motor 404 may be driven by a haptic driver (not shown) and used to generate haptic feedback. In a second mode of operation, a signal sensed on the terminals of the haptic motor 406 may be equalised by the equaliser module 408. The equalised signal may be subtracted from a microphone signal by the mixer module 412. The resulting mixed signal may be output on the mixer output 414. The equaliser may apply equalisation filtering to effectively increase the bandwidth of the frequency response of the haptic motor 404. The haptic motor 404 may typically have a frequency response with a high Q factor (approximately 20). Haptic motor 404 may have a resonant frequency of approximately 200 Hz. The haptic motor 404 may be a linear resonance actuator.

The fusion module 416 which may also be considered as a controller may improve the perceived speech quality by removing unwanted noise artefacts detected via the haptic motor 404. The fusion module 416 may be implemented in hardware, software, or a combination of hardware and software.

Figure 7:
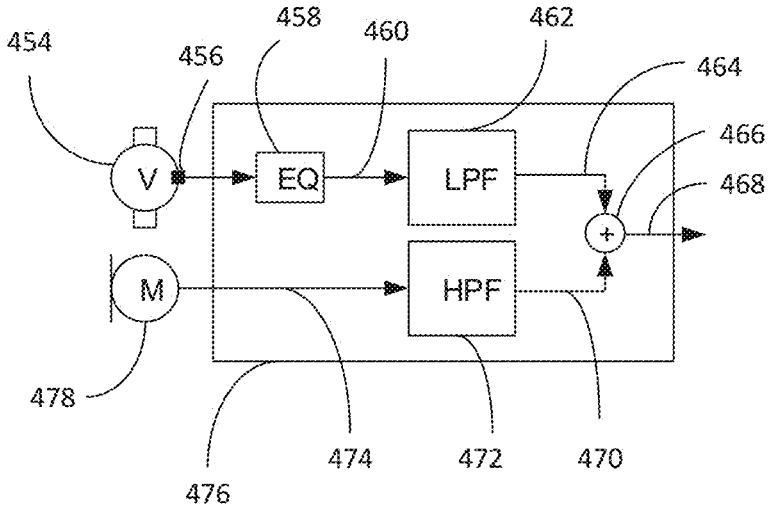
FIG. 7 shows a mobile device according to an embodiment.

FIG. 7 shows a mobile device 450 including an example of a fusion module 476. A haptic motor 454 may have a terminal 456 connected to an equaliser 458 contained in the fusion module 476. The output 460 of equaliser 458 may be connected to a low-pass filter 462. The low-pass filter output 464 may be connected to a mixer 466. A microphone 478 may have an output 474 connected to a high-pass filter 472. The high-pass filter may be included in the fusion module 476. The high-pass filter output 470 may be connected to a mixer module 466. The mixer module may generate an output on mixer output 468 which may also be the output of the fusion module 476. In a first mode of operation of the mobile device 450, the haptic motor 454 may be driven by a haptic motor driver (not shown) which is connected to the haptic motor terminals 456. In this mode of operation, the haptic motor 454 may be used to generate vibrations or a haptic feedback signal to a user of the mobile device 450. In a second mode of operation, the haptic motor 454, which may be a linear resonance actuator, may be used in reverse to detect a vibration from an external source which may then induce a signal on the haptic motor terminals 456. In this mode of operation the vibration signal induced on the haptic motor terminals 456 by an external vibration may be equalised by the equaliser 458. The equaliser 458 may compensate for the narrow band sensitivity of the haptic motor 454. Consequently the equaliser 458 may be considered to effectively increase the bandwidth of the frequency response of the haptic motor 454. The equalised vibrator signal may be output on the equaliser output 460 and subsequently filtered by the low-pass filter 462. A signal detected by the microphone 478 may be filtered by the high-pass filter 472. The high-pass filtered output may be mixed with the low-pass filtered output by the mixer 466.

The combined signal from the haptic motor 454 and the microphone 478 may then be output on the mixer output 468. In this case the desired signal consists of low frequencies from the signal detected by the haptic motor 454 and higher frequencies from the signal detected by the microphone 478. If the signal detected by the haptic motor 454 is for example speech transmitted via bone conduction of a user, there will be relatively little noise contamination of the speech signal at low frequencies when compared to the speech signal received from the microphone 478. Hence by filtering out the low frequency components from the signal received from the microphone and using the low frequency components from the signal detected via the haptic motor 454, the noise components and the combined signal may be reduced and consequently the speech quality reproduction may be improved.

In other examples the fusion module may use frequency domain processing and frequency dependent criteria, for example based on the signal-to-noise ratio of the induced signal in a particular frequency band.

In other examples, the equalizer may be an adaptive equalizer. An adaptive equalizer may compare a signal from the microphone which may be considered as the reference with the equalized output signal. A difference between the microphone signal and the equalized output signal may be considered as an error signal. The adaptive equalization parameters may be altered for example by least mean square filtering to minimize the error signal. In this way the response of the microphone and the haptic feedback element may be aligned.

Figure 8:
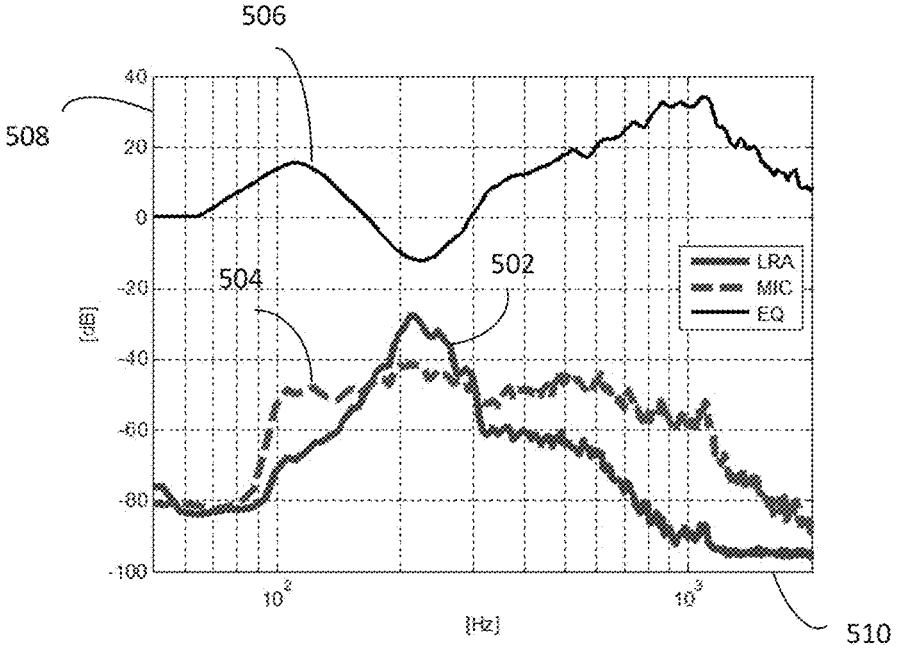
FIG. 8 illustrates a graph showing an example equalizer response.

FIG. 8 shows a graph 500 illustrating an example equalization response for a mobile phone including a LRA vibrator for haptic feedback. The x axis 510 shows the frequency between 50 Hz and 2 kHz and the y axis 508 shows the gain in relative decibels ranging from −100 dB to +40 dB. Line 502 shows the LRA signal having a resonant frequency of approximately 220 Hz. Line 504 shows the mouth microphone signal which may be considered as the reference and line 506 shows an example equalising (EQ) filter which may be applied to the LRA signal in order to match the microphone signal. The EQ Filter boost may be bounded in frequency to prevent excessive noise boosting. The bounded frequency may be a few hundred hertz.

Figure 9:
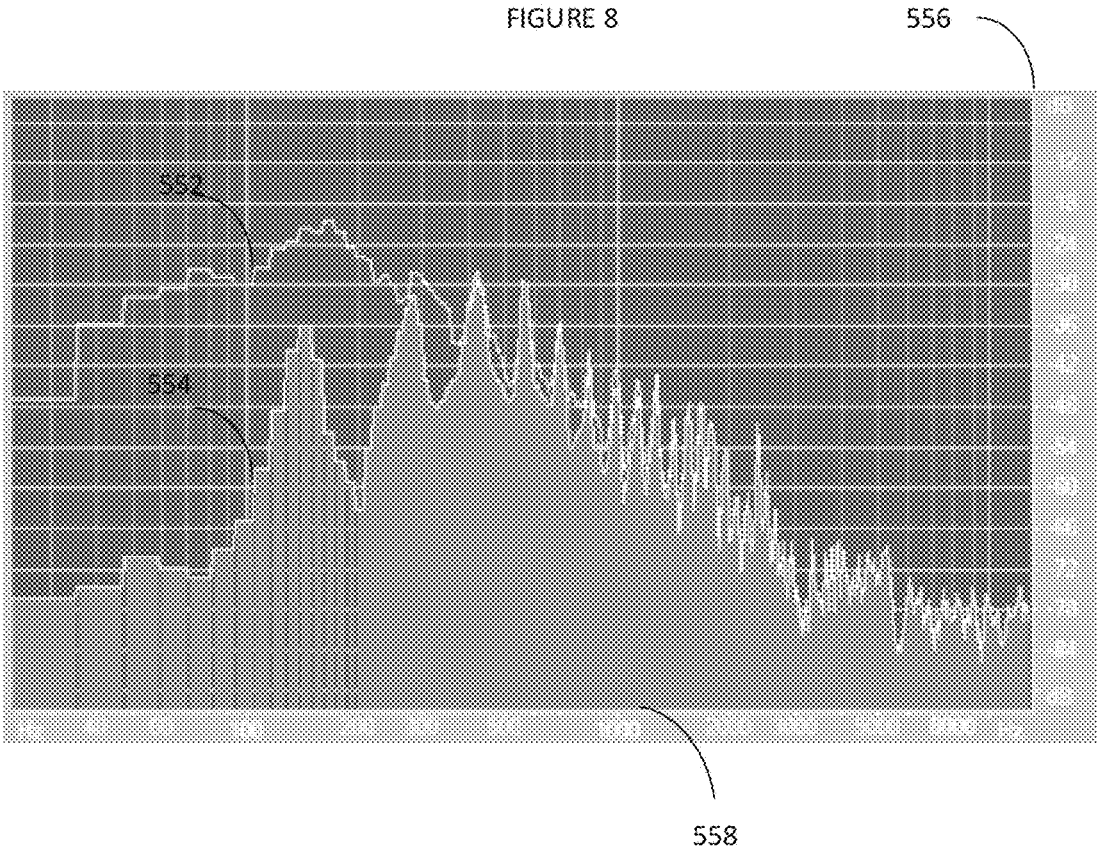
FIG. 9 shows a graph of an example speech signal processed from a haptic feedback element and a microphone.

FIG. 9 illustrates a graph 550 showing an example speech signal response using a signal induced on the terminals of a linear resonance actuator in combination with a microphone signal. In this case the linear resonance actuator is used to characterize the noise so may be implemented for example using the embodiment of FIG. 4. In this case the linear resonance actuator may respond to predominantly low frequency components of less than 500 Hz. The x axis 558 shows the frequency ranging from 0 to 10 kHz. The y axis 556 shows the gain in relative decibels ranging from −95 db to 0 db. The graph line 552 shows the response of the microphone signal in combination with the alone to a speech input. The graph line 554 shows the combined response of the microphone and the linear response actuator showing that the low frequency components of less than 200 Hz are significantly reduced. For example at 100 Hz the microphone response shows a gain of −30 dB whereas the combined response indicates a gain of −65 dB. In this case when speaking in the presence of background wind noise which has predominantly low frequency components, the combined response of the linear resonance actuator and the microphone results in a surprising improvement in the signal to noise ratio than the microphone alone. This may result in improved intelligibility of the detected speech.

Figure 10:
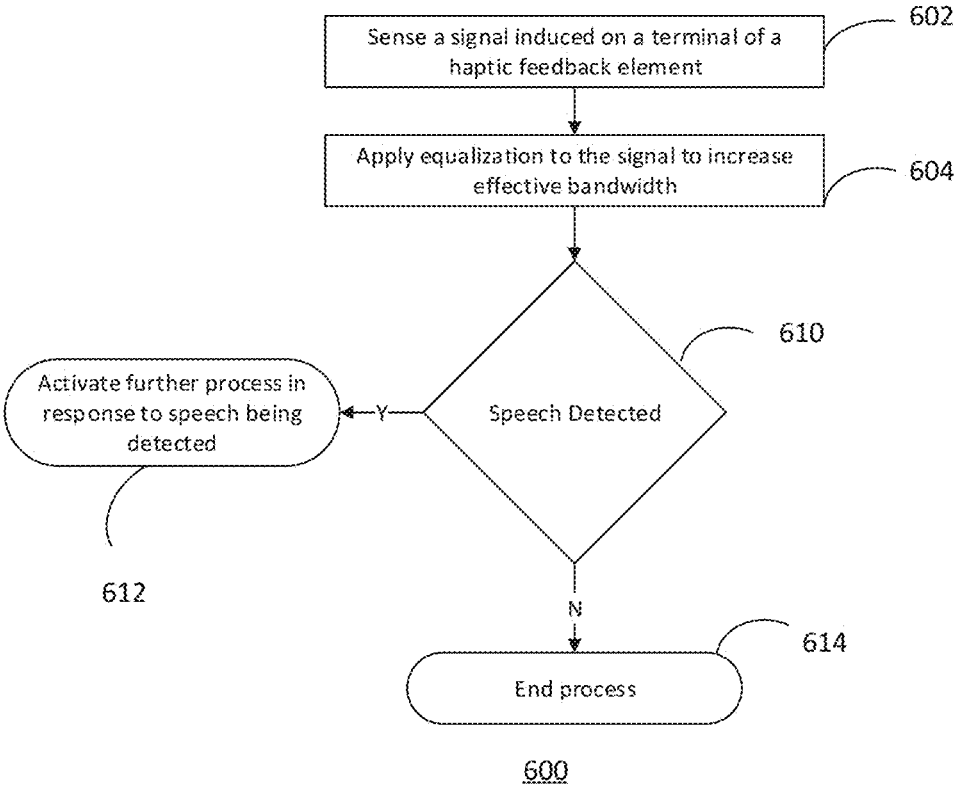
FIG. 10 shows a method of controlling a haptic feedback element according to an embodiment.

FIG. 10 illustrates a method of processing a signal induced on one or more terminals of a haptic feedback element 600. The haptic feedback element may be incorporated in a mobile phone or other mobile device. The haptic feedback element may be used in a mobile phone in a vibrate mode to cause vibrations which can be felt by a user of the mobile phone or other mobile device. In step 602 a signal may be sensed which is induced on a terminal of the haptic feedback element. In step 604 equalisation may be applied to the induced signal to increase the effective bandwidth of the induced signal. In step 610 a check may be made to determine whether or not the induced equalised signal contain speech. If speech has been detected in step 610 and the method may activate a further process in response to speech been detected in step 612. This activation step may for example include activating an additional processing unit or enabling further circuitry. Returning to step 610, if no speech is detected then process moves to step 614 and finishes.

Figure 11:
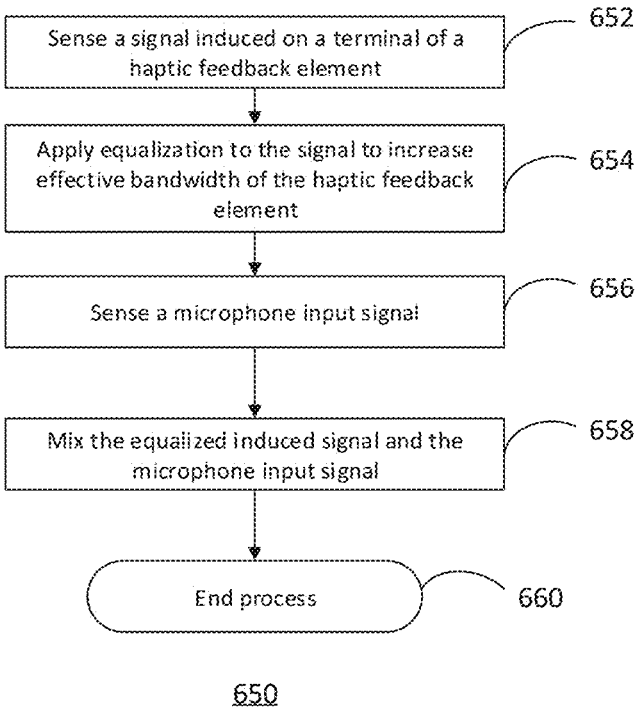
FIG. 11 illustrates a method of controlling a haptic feedback element according to an embodiment.

FIG. 11 illustrates a further method of processing a signal induced on one or more terminals of a haptic feedback element 650. In step 652 and the signal induced on a terminal of a haptic feedback element may be sensed. In step 654 equalisation may be applied to the signal to increase the effective bandwidth of the haptic feedback element. The effective feedback may be increased for example from less than 100 Hz to greater than 400 Hz. In step 656 a microphone input signal may be sensed. In step 658 the equalised induced signal and the microphone input signal may be combined or mixed. In step 660 process may finish.

A controller suitable for a haptic feedback element is described. The haptic feedback element may generate haptic vibrations, wherein the controller comprises a sense input and is configured to sense a signal induced on at least one terminal of the haptic feedback element in response to an external vibration source. The controller may sense vibrations induced one or more terminals of a haptic feedback element. The external vibration source may be due to speech transmitted via bone conduction which may be detected and subsequently processed.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub combination.

The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, a single processor or other unit may fulfil the functions of several means recited in the claims and reference signs in the claims shall not be construed as limiting the scope of the claims.

The invention claimed is:

1. A mobile device, comprising:

a controller, including:

a haptic sense input configured to receive a haptic signal from a haptic feedback element;

wherein the haptic feedback element is responsive to physical contact vibrations;

a microphone input configured to receive a microphone signal from a microphone;

wherein the microphone is responsive to air vibrations; and wherein the controller is configured to combine the haptic signal and the microphone signal into a speech signal;

the haptic feedback element having a haptic feedback element terminal;

a haptic feedback element driver having an output switchably coupled to the haptic feedback element terminal;

wherein the haptic sense input is switchably coupled to the haptic feedback element terminal; and wherein the controller is configured to couple an output of an amplifier to the haptic feedback element terminal in a first mode of operation and to couple the sense input to the haptic feedback element terminal in a second mode of operation.

2. The device of claim 1 wherein the controller is further configured to detect speech in the haptic signal.

3. The device of claim 1 further configured to detect noise in the haptic signal.

4. The device of claim 1 comprising a low pass filter coupled to the haptic sense input, a high-pass filter coupled to the microphone input; and a mixer coupled to an output of the high-pass filter and an output of a low pass filter;

wherein the mixer combines the haptic signal and the microphone signal into the speech signal.

5. The device of claim 1 comprising an equalizer coupled to the haptic sense input and further configured to apply equalization to the haptic signal such that an effective passband of the haptic feedback element is increased.

6. The device of claim 1 wherein the haptic signal includes an audio frequency signal.

7. The device of claim 1 wherein the haptic feedback element includes an electrodynamic haptic feedback element.

8. The device of claim 1 further comprising a low-pass filter configured to filter the haptic signal, a high-pass filter configured to filter the microphone signal and wherein the controller is configured to mix the high-pass filtered signal and the low-pass filtered signal into the speech signal.

9. The device of claim 1 further comprising an equalizer configured to equalize the haptic signal to increase an effective passband of the haptic feedback element.

10. The mobile device of claim 1 wherein the haptic feedback element is a bone conduction device.

11. The device of claim 1, wherein the microphone is responsive only to air vibrations.

12. The device of claim 1, wherein the haptic feedback element is responsive only to physical contact vibrations.

13. The device of claim 1, wherein the controller is configured to combine the haptic signal and the microphone signal into a single combined speech signal.

* * * * *